US005656408A

United States Patent [19]

Silence

[11] Patent Number: 5,656,408

[45] Date of Patent: Aug. 12, 1997

[54] COATED CARRIER PARTICLES

[75] Inventor: Scott M. Silence, Penfield, N.Y.

[73] Assignee: Xerox Corporation, Stamford, Conn.

[21] Appl. No.: 638,668

[22] Filed: Apr. 29, 1996

[51] Int. Cl.[6] ..... G03G 9/107

[52] U.S. Cl. ..... 430/106.6; 430/108

[58] Field of Search ..... 430/106, 108

[56] References Cited

U.S. PATENT DOCUMENTS 3,590,000 6/1971 Palermiti et al. ..... 252/62.1

4,935,326 6/1990 Creatura et al. ..... 430/108

4,937,166 6/1990 Creatura et al. ..... 430/108

5,376,494 12/1994 Mahabadi et al. ..... 430/137

*Primary Examiner*—John Goodrow

*Attorney, Agent, or Firm*—E. D. Palallo

[57] ABSTRACT

A carrier composition comprised of a core with a coating thereover comprised of a polyester, and which polyester comprises linear portions and crosslinked portions, and wherein said crosslinked portions are comprised of high density crosslinked microgel particles.

35 Claims, No Drawings

COATED CARRIER PARTICLES

BACKGROUND OF THE INVENTION

This invention is generally directed to developer compositions, and more specifically, the present invention relates to developer compositions with coated carrier particles prepared by dry powder processes. In embodiments of the present invention, the carrier particles are comprised of a core with coating thereover generated from certain polyester resins, especially crosslinked polyesters as illustrated in U.S. Pat. Nos. 5,376,494 and 5,227,560, the disclosures of which are totally incorporated herein by reference. Moreover, in another embodiment of the present invention the carrier particles are prepared by a dry coating process wherein the crosslinked polymer is applied to the carrier enabling insulating particles with relatively constant conductivity parameters; and also wherein the triboelectric charge on the carrier can vary significantly depending on the coatings selected. Developer compositions comprised of the carrier particles prepared by the dry coating process of the present invention are useful in electrostatographic or electrophotographic imaging systems, especially xerographic imaging and printing processes. Additionally, developer compositions comprised of substantially insulating carrier particles prepared in accordance with the process of the present invention are useful in imaging methods wherein relatively constant conductivity parameters are desired. Furthermore, in the aforementioned imaging processes the triboelectric charge on the carrier particles can be preselected depending on the polymer composition applied to the carrier core. The reactive extruded polyesters selected as a carrier coating in embodiments of the present invention are jettable binder polymers; and moreover, the aforementioned coatings, which can be selected with gel contents of up to about 45 percent, and preferably from about 20 to about 40 percent, have no, or minimal emission on melting, and these coatings possess excellent mechanical toughness. Further, in embodiments the reactive extruded polyester coatings of the present invention can be utilized as a contrast carrier coating, can be selected as one component of a coating carrier mixture, and can contain dispersed therein conductive components, such as conductive carbon blacks or metal oxides in amounts, for example, of from about 1 to about 70, and preferably from about 20 to about 60 weight percent. Moreover, the triboelectric characteristics of the coated carrier can be altered and the conductivity increased by the addition to the carrier coating, or coatings of conductive components, such as carbon black, metal oxides like tin oxide, charge additives, such as distearyl dimethyl ammonium methyl sulfate (DDAMS), azo complexes, such as bis[1-[(3,5-disubstituted-2-hydroxyphenyl)azo]-3-(monosubstituted)-2-naphthalenolato(2-)] chromate(1-), ammonium sodium and hydrogen (TRH), and other known toner charge additives, and the like. Also, in embodiments of the present invention the carrier coating characteristics can be modified by adding during the preparation thereof an initiator, such as benzoyl peroxide, to, for example, promote further crosslinking of the reactive extruded polyester.

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith as it is these values that enable continued constant developed images of high quality and excellent resolution.

Additionally, carrier particles for use in the development of electrostatic latent images are described in many patents including, for example, U.S. Pat. No. 3,590,000. These carrier particles may consist of various cores, including steel, with a coating thereover of fluoropolymers, and terpolymers of styrene, methacrylate, and silane compounds. Past efforts have focused on the attainment of coatings for carrier particles for the purpose of improving development quality, and also to permit particles that can be recycled, and that do not adversely effect the imaging member in any substantial manner. Many of the present commercial coatings can deteriorate rapidly, especially when selected for a continuous xerographic process where the entire coating may separate from the carrier core in the form of chips or flakes; and fail upon impact, or abrasive contact with machine parts and other carrier particles. These flakes or chips, which cannot generally be reclaimed from the developer mixture, have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits.

There are also illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent, the disclosure of which has been totally incorporated herein by reference, are suitable for their intended purposes, the conductivity values of the resulting particles are not constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the invention of the present application, the conductivity of the resulting carrier particles are substantially constant, and moreover, the triboelectric values can be selected to vary significantly, for example, from less than −10 microcoulombs per gram of charge imparted to the toner to greater than −70 microcoulombs per gram, depending on the polymer mixture selected for affecting the coating processes.

There is illustrated in U.S. Pat. Nos. 4,937,166 and 4,935,326, the disclosures of which are totally incorporated herein by reference, carrier containing a mixture of polymers, such as two polymers, not in close proximity in the triboelectric series.

The present invention in embodiments provides numerous advantages and efficiencies over the prior art. Among those advantages are the following:

1) Additives or combination of additives, such as conductive carbon blacks, conductive metal oxides including tin oxide, charge control agents including distearyl dimethyl ammonium methyl sulfate (DDAMS), bis[1-[(3,5-disubstituted-2-hydroxyphenyl)azo]-3-(mono-substituted)-2-naphthalenolato(2-)] chromate(1-), ammonium sodium and hydrogen (TRH), cetyl pyridinium chloride (CPC), and benzoic acid, 2-[6-(ethylamino)-3-(ethylamino)-2,7-dimethyl-3H-xanthen-9-yl]-ethyl ester, compound with molybedenum tungsten hydroxide oxide phosphate or FANAL PINK® D4830 can be incorporated into the polymer in effective amounts, such as about 1 weight percent, by known melt mix and particle size attrition techniques to modify the carrier triboelectric and conductivity properties of the polymer. This eliminates the need to redesign the chemical process by which the polymer is generated for incorporation of additional or different components therein or thereon.

2) The rheological properties of the polymer, which control both the ability of the polymer to coat the carrier surface and the mechanical toughness of the carrier coating, are controlled by altering the polymer gel content by known melt mix techniques and are tunable over the range indicated above. This eliminates the need to redesign the chemical process by which the polymer is prepared to alter the rheological properties of the polymer.

3) The use of a single crosslinked polyester host polymer to generate all of the polymer composites by incorporation of additives, such as conductive carbon blacks, conductive metal oxides including tin oxide, charge control agents including distearyl dimethyl ammonium methyl sulfate (DDAMS), bis[1-[(3,5-disubstituted-2-hydroxyphenyl)azo]-3-(monosubstituted)-2-naphthalenolato(2-)] chromate(1-), ammonium sodium and hydrogen (TRH), cetyl pyridinium chloride (CPC), and benzoic acid, 2-[6-(ethylamino)-3-(ethylamino)-2,7-dimethyl-3H-xanthen-9-yl]-ethyl ester, compound with molybedenum tungsten hydroxide oxide phosphate (FANAL PINK® D4830) to control the carrier triboelectric charge over the range of from about −7 to about −70 microcoulombs per gram, and the carrier conductivity over the range of from about $10^{-15}$ mho/cm to about $10^{-6}$ mho/cm which ensures the miscibility of two (or more) polymers at a given carrier processing temperature, such as from about 320° F. to about 650° F., which are two polymers ratioed at from about 10 percent to about 90 percent of the first polymer coating and from about 90 to about 10 percent of the second polymer coating, to control either the carrier triboelectric or carrier conductivity properties.

4) No solvents are needed in either the manufacture of the crosslinked resin, the polymer composite or the coated carrier, reducing emission of volatile organic compounds (VOCs) to a minimum.

With further reference to the prior art, carriers obtained by applying insulating resinous coatings to porous metallic carrier cores using solution coating techniques are undesirable from many viewpoints. For example, the coating material will usually reside in the pores of the carrier cores, rather than at the surfaces thereof; and, therefore, is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves handling excessive quantities of solvents, and further, usually these processes result in low product yields. Also, solution coated carrier particles, when combined and mixed with finely divided toner particles, provide in some instances triboelectric charging values which are too low for many uses. The powder coating processes of the present invention overcome these disadvantages, and further enable developers that are capable of generating high and useful triboelectric charging values with finely divided toner particles; and also wherein the carrier particles are of substantially constant conductivity. Further, when resin coated carrier particles are prepared by the powder coating process of the present invention, the majority of the coating materials are fused to the carrier surface thereby reducing the number of toner impaction sites on the carrier material. Additionally, there can be achieved with the process of the present invention, and the carriers thereof, independent of one another, desirable triboelectric charging characteristics and conductivity values; that is, for example the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values in a number of different combinations.

Thus, for example, there can be formulated in accordance with the invention of the present application developers with conductivities of from about $10^{-6}$ mho $(cm)^{-1}$ to $10^{-17}$ mho $(cm)^{-1}$ as determined in a magnetic brush conducting cell, and triboelectric charging values of from about a −7 to a −70, and in embodiments from about −10 to about −30 microcoulombs per gram on the carrier particles as determined by the known Faraday Cage technique. Thus, the developers of the present invention can be formulated with constant conductivity values with different triboelectric charging characteristics by, for example, maintaining the same total coating weight on the carrier particles and changing the ratio of two (or more) polymers which comprise the coating. Similarly, there can be formulated developer compositions wherein constant triboelectric charging values are achieved and the conductivities are altered by retaining the same total coating weight on the carrier particles and changing the ratio of two (or more) polymers which comprise the coating.

Other patents of interest include U.S. Pat. No. 3,939,086, which teaches steel carrier beads with polyethylene coatings, see column 6; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY OF THE INVENTION

It is an object of the present invention to provide toner and developer compositions with carrier particles containing a polymer coating.

In another object of the present invention there are provided dry coating processes for generating carrier particles of substantially constant conductivity parameters.

In yet another object of the present invention there are provided dry coating processes for generating carrier particles of substantially constant conductivity parameters, and a wide range of preselected triboelectric charging values.

In yet a further object of the present invention there are provided carrier particles comprised of a reactive extruded polyester coating, or a mixture of such a polyester with a second polymer, including a second polyester in embodiments not in close proximity in the triboelectric series.

In still a further object of the present invention there are provided carrier particles of insulating characteristics comprised of a core with a coating thereover generated from a mixture of polymers, one of which is a reactive extruded crosslinked polyester, and wherein in embodiments the carrier coating polymer contains dispersed therein conductive components, additives, such as charge additives, and the like.

Further, in an additional object of the present invention there are provided carrier particles comprised of a core with a coating thereover wherein the triboelectric charging values imparted to the toner are from about −10 microcoulombs to about −70 microcoulombs per gram at the same coating weight.

Also, in another object of the present invention there are provided positively charged toner compositions, or negatively charged toner compositions having admixed therein carrier particles with a coating thereover of a crosslinked polyester polymer.

These and other objects of the present invention are accomplished in embodiments by providing developer compositions comprised of toner particles, and carrier particles prepared by a powder coating process; and wherein the carrier particles are comprised of a core with a certain coating thereover. More specifically, the carrier particles selected can be prepared by mixing low density porous magnetic, or magnetically attractable metal core carrier particles with from, for example, between about 0.05 percent and about 3 percent by weight, based on the weight of the coated carrier particles, of a crosslinked polyester polymer until adherence thereof to the carrier core by mechanical impaction or electrostatic attraction; heating the mixture of carrier core particles and polymer to a temperature, for example, of between from about 200° F. to about 550° F. for an effective period of, for example, from about 10 minutes to about 60 minutes enabling the polymer to melt and fuse to the carrier core particles; cooling the coated carrier particles; and thereafter, classifying the obtained carrier particles to a desired particle size.

In embodiments of the present invention there are provided carrier particles comprised of a core with a coating thereover comprised of of a first dry crosslinked polymer component and an optional second dry polymer component, which first and second polymers are not in close proximity in the triboelectric series. Therefore, the aforementioned carrier compositions can be comprised of known core materials including iron with a dry polymer coating mixture thereover. Subsequently, developer compositions of the present invention can be generated by admixing the aforementioned carrier particles with a toner composition comprised of resin particles and pigment particles.

Embodiments of the present invention include a carrier composition comprised of a core with a coating thereover comprised of a polyester, and which polyester comprises linear portions and crosslinked portions, and wherein said crosslinked portions are comprised of high density crosslinked microgel particles; a carrier comprised of a core with a polymer coating thereover comprised of a crosslinked polyester and which polyester comprises linear portions and crosslinked portions, and wherein said crosslinked portions consist essentially of high density crosslinked microgel particles, and wherein the gel content thereof is from about 1 to about 50 percent; and a process for the preparation of carrier particles with substantially stable conductivity parameters, which comprises (1) mixing carrier cores with the polyester of claim 1; (2) dry mixing the carrier core particles and the polymer for a sufficient period of time enabling the polymer to adhere to the carrier core particles; (3) heating the mixture of carrier core particles and polymer to a temperature of between about 200° F. and about 550° F., whereby the polymer melts and fuses to the carrier core particles; and (4) thereafter cooling the resulting coated carrier particles.

Various suitable solid core carrier materials can be selected for the developers of the present invention. Characteristic core properties of importance include those that will enable the toner particles to acquire a positive charge or a negative charge; and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics. Examples of carrier cores that can be selected include iron, steel, ferrites such as Sr (strontium)-ferrite, Ba-ferrite, Cu/Zn-ferrite, and Ni/Zn-ferrite, magnetites, nickel, and mixtures thereof. Preferred carrier cores include ferrites, and sponge iron, or steel grit with an average particle size diameter of from between about 30 microns to about 200 microns.

The polyester coating selected comprises crosslinked portions and linear portions. The crosslinked portions comprise very high molecular weight gel particles having average diameter less than about 0.1 micron and with high density crosslinking insoluble in substantially any solvent, including tetrahydrofuran, toluene, and the like. The linear portion comprises low molecular weight resin soluble in various solvents, such as for example tetrahydrofuran, toluene, and the like, and the high molecular weight highly crosslinked gel particles are substantially uniformly distributed in the linear portions. Substantially no portion of the resin comprises sol or low density crosslinked polymer, such as that which would be obtained in conventional crosslinking processes such as polycondensation, bulk, solution, suspension, emulsion and dispersion polymerization processes. This polymer resin coating may be fabricated by a reactive melt mixing process. In this process, a reactive base resin, preferably unsaturated polyester resin, is partially crosslinked at high temperature and under high shear, preferably by using chemical initiators; the crosslinked portion consisting essentially of microgel particles with an average volume particle diameter up to 0.1 micron, preferably about 0.005 to about 0.1 micron, said microgel particles being substantially uniformly distributed throughout the linear portions. In this resin, the crosslinked portion consists essentially of microgel particles, preferably up to about 0.1 micron in average volume particle diameter as determined by scanning electron microscopy and transmission electron microscopy. When produced by a reactive melt mixing process wherein the crosslinking occurs at high temperature and under high shear, the size of the microgel particles does not continue to grow with increasing degree of crosslinking. Also, the microgel particles are distributed substantially uniformly throughout the linear portion.

The crosslinked portions or microgel particles are prepared in a manner that there is substantially no distance between the polymer chains. Thus, the crosslinking is preferably not accomplished via monomer or polymer bridges. The polymer chains are directly connected, for example, at unsaturation sites or other reactive sites, or in some cases by a single intervening atom, such as, for example, oxygen. Therefore, the crosslinked portions are very dense and do not swell as much as gel produced by conventional crosslinking methods. This crosslink structure is different from conventional crosslinking in which the crosslink distance between chains is quite large with several monomer units, and where the gels swell very well in a solvent such as tetrahydrofuran or toluene. These highly crosslinked dense microgel particles distributed throughout the linear portion impart elasticity to the resin which improves the resin offset properties, while not substantially affecting the resin minimum fix temperature. In preferred embodiments, the base resin has a degree of unsaturation of about 0.1 to about 30 mole percent, preferably about 5 to about 25 mole percent. The shear levels should be sufficient to inhibit microgel growth above about 0.1 micron average particle diameter and to ensure substantially uniform distribution of the microgel particles. These shear levels are readily available in melt mixing devices such as extruders.

The polyester resin selected as the carrier coating in the present invention has a weight fraction of the microgel (gel content) in the resin mixture in the range typically from about 0.001 to about 50 weight percent, preferably about 0.1 to about 40, or about 25 to about 35 weight percent. The linear portion is comprised of base resin, preferably unsaturated polyester, in the range of from about 50 to about 99.999 percent by weight of said resin, and preferably in the range of from about 60 to about 99.9 or about 75 to about 65 percent by weight of said resin. The linear portion of the resin preferably consists essentially of low molecular weight reactive base resin which did not crosslink during the crosslinking reaction, preferably unsaturated polyester resin.

According to embodiments of the invention, the number average molecular weight ($M_n$) of the linear portion as measured by gel permeation chromatography (GPC) is in the range typically of from about 1,000 to about 20,000, and preferably from about 2,000 to about 5,000. The weight average molecular weight ($M_w$) of the linear portion is in the range typically of from about 2,000 to about 40,000, and preferably from about 4,000 to about 15,000. The molecular weight distribution ($M_w/M_n$) of the linear portion is in the range typically of from about 1.5 to about 6, and preferably from about 2 to about 4. The onset glass transition temperature ($T_g$) of the linear portion as measured by differential scanning calorimetry (DSC) for preferred embodiments is in the range typically of from about 50° C. to about 70° C., and preferably from about 51° C. to about 60° C. Melt viscosity of the linear portion of preferred embodiments as measured with a mechanical spectrometer at 10 radians per second is from about 5,000 to about 200,000 poise, and preferably from about 20,000 to about 100,000 poise at 100° C., and drops sharply with increasing temperature to from about 100 to about 5,000 poise, and preferably from about 400 to about 2,000 poise, as temperature rises from 100° C. to 130° C.

The polymer coating resin contains a mixture of crosslinked resin microgel particles and a linear portion as illustrated herein. In embodiments, the onset $T_g$ of the polyester coating is in the range typically of from about 50° C. to about 70° C., and preferably from about 51° C. to about 60° C., and the melt viscosity as measured with a mechanical spectrometer at 10 radians per second is from about 5,000 to about 200,000 poise, and preferably from about 20,000 to about 100,000 poise, at 100° C. and from about 10 to about 20,000 poise at 160° C. As the degree of crosslinking or microgel content increases, the low temperature melt viscosity does not change appreciably, while the high temperature melt viscosity goes up. In an exemplary embodiment, the hot offset temperature can increase approximately 30 percent. This can be achieved by crosslinking in the melt state at high temperature and high shear such as, for example, by crosslinking an unsaturated polyester using a chemical initiator in an extruder resulting in the formation of microgel alone, distributed substantially uniformly throughout the linear portion, and substantially no intermediates or sol portions, which are crosslinked polymers with low crosslinking density. When crosslinked intermediate polymers are generated by conventional polymerization processes, the viscosity curves generally shift in parallel from low to high degree of crosslinking. This is reflected in increased hot offset temperature, but also increased minimum fix temperature.

In a preferred embodiment, the crosslinked portion consists essentially of very high molecular weight microgel particles with high density crosslinking (as measured by gel content), and which are not soluble in substantially any solvents such as, for example, tetrahydrofuran, toluene and the like. As discussed above, the microgel particles are highly crosslinked polymers with a very small, if any, crosslink distance. This type of crosslinked polymer may be formed by reacting chemical initiator with linear unsaturated polymer, and more preferably linear unsaturated polyester at high temperature and under high shear. The initiator molecule breaks into radicals and reacts with one or more double bond or other reactive site within the polymer chain forming a polymer radical. This polymer radical reacts with other polymer chains or polymer radicals many times, forming a highly and directly crosslinked microgel. This renders the microgel very dense and results in the microgel not swelling very well in solvent. The dense microgel also imparts elasticity to the resin and increases its hot offset temperature while not affecting its minimum fix temperature.

The weight fraction of the microgel (gel content) in the polymeric carrier coating resin may be defined as follows:

$$\text{Gel Content} = \frac{\text{Total Sample Weight} - \text{Weight of Soluble Polymer}}{\text{Total Sample Weight}} \times 100\%$$

The gel content may be calculated by measuring the relative amounts of linear, soluble polymer and the nonlinear, crosslinked polymer utilizing the following procedure: (1) the sample of the crosslinked resin to be analyzed, in an amount between 145 and 235 milligrams, is weighed directly into a glass centrifuge tube; (2) 45 milliliters of toluene are added and the sample is put on a shaker for at least 3 hours, preferably overnight; (3) the sample is then centrifuged at about 2,500 rpm for 30 minutes and then a 5 milliliter aliquot is carefully removed and put into a preweighed aluminum dish; (4) the toluene is allowed to air evaporate for about 2 hours, and then the sample is further dried in a convection oven at 60° C. for about 6 hours or to constant weight; and (5) the sample remaining, times nine, gives the amount of soluble polymer. Thus, utilizing this quantity in the above equation, the gel content can be easily calculated.

Linear unsaturated polyesters used as the base resin for the preparation of the polyester coating polymer include low molecular weight condensation polymers which may be formed by the step-wise reactions between both saturated and unsaturated diacids (or anhydrides) and dihydric alcohols (glycols or diols). The resulting unsaturated polyesters are reactive (e.g., crosslinkable) on two fronts: (i) unsaturation sites (double bonds) along the polyester chain, and (ii) functional groups, such as carboxyl, hydroxy, etc. groups, amenable to acid-base reactions. Typical unsaturated polyester base resins useful for this invention are prepared by melt polycondensation or other polymerization processes using diacids and/or anhydrides and diols. Suitable diacids and dianhydrides include but are not limited to saturated diacids and/or anhydrides, such as for example succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like, and mixtures thereof; and unsaturated diacids and/or anhydrides, such as for example maleic acid, fumaric acid, chloromaleic acid, methacrylic acid, acrylic acid, itaconic acid, citraconic acid, mesaconic acid, maleic anhydride, and the like, and mixtures thereof. Suitable diols include, but are not limited to, for example, propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like, and mixtures thereof, soluble in good solvents such as, for example, tetrahydrofuran, toluene, and the like.

Preferred unsaturated polyester base resins are prepared from diacids and/or anhydrides such as, for example, maleic anhydride, fumaric acid, and the like, and mixtures thereof, and diols such as, for example, propoxylated bisphenol-A, propylene glycol, and the like, and mixtures thereof. A particularly preferred polyester is poly(propoxylated bisphenol A fumarate).

Chemical initiators, such as, for example, organic peroxides or azo-compounds, are preferred for the preparation of the crosslinked resins of the invention. Suitable organic peroxides include diacyl peroxides such as, for example, decanoyl peroxide, lauroyl peroxide and benzoyl peroxide, ketone peroxides such as, for example, cyclohexanone peroxide and methyl ethyl ketone; alkyl peroxyesters such as, for example, t-butyl peroxy neodecanoate, 2,5-dimethyl 2,5-di(2-ethyl hexanoyl peroxy)hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy) hexane, oo-t-butyl o-(2-ethyl hexyl) mono peroxy carbonate, and oo-t-amyl o-(2-ethyl hexyl) mono peroxy carbonate, alkyl peroxides such as, for example, dicumyl peroxide, 2,5-dimethyl 2,5-di(t-butyl peroxy) hexane, t-butyl cumyl peroxide, α-α-bis(t-butyl peroxy) diisopropyl benzene, di-t-butyl peroxide, and 2,5-dimethyl 2,5-di(t-butyl peroxy) hexyne-3; alkyl hydroperoxides such as, for example, 2,5-dihydro peroxy 2,5-dimethyl hexane, cumene hydroperoxide, t-butyl hydroperoxide and t-amyl hydroperoxide; and alkyl peroxyketals such as, for example, n-butyl 4,4-di(t-butyl peroxy) valerate, 1,1-di(t-butyl peroxy) 3,3,5-trimethyl cyclohexane, 1,1-di(t-butyl peroxy) cyclohexane, 1,1-di(t-amyl peroxy) cyclohexane, 2,2-di(t-butyl peroxy) butane, ethyl 3,3-di(t-butyl peroxy) butyrate, and ethyl 3,3-di(t-amyl peroxy) butyrate. Suitable azo compounds include azobis-isobutyronitrile, 2,2'-azobis(isobutyronitrile), 2,2'-azobis(2,4-dimethyl valeronitrile), 2,2'-azobis(methyl butyronitrile), 1,1'-azobis(cyano cyclohexane), and other similar known compounds.

By permitting use of low concentrations of chemical initiator and utilizing all of it in the crosslinking reaction, usually in the range of from about 0.01 to about 10 weight percent, and preferably in the range of from about 0.1 to about 4 weight percent, the residual contaminants produced in the crosslinking reaction in preferred embodiments can be minimal. Since the crosslinking can be carried out at high temperature, the reaction is very fast (e.g., less than 10 minutes, preferably about 2 seconds to about 5 minutes residence time) and thus little or no unreacted initiator remains in the product.

The low melt polyester coating resin may be prepared by a reactive melt mixing process wherein reactive resins are partially crosslinked. For example, low melt resins may be fabricated by a reactive melt mixing process comprising the steps of: (1) melting reactive base resin, thereby forming a polymer melt, in a melt mixing device; (2) initiating crosslinking of the polymer melt, preferably with a chemical crosslinking initiator and increased reaction temperature; (3) retaining the polymer melt in the melt mixing device for a sufficient residence time that partial crosslinking of the base resin may be achieved; (4) providing sufficiently high shear during the crosslinking reaction to keep the gel particles formed during crosslinking small in size and well distributed in the polymer melt; and (5) optionally devolatilizing the polymer melt to remove any effluent volatiles. The high temperature reactive melt mixing process allows for very fast crosslinking which enables the production of substantially only microgel particles, and the high shear of the process prevents undue growth of the microgels and enables the microgel particles to be uniformly distributed in the resin.

In a preferred embodiment, the process comprises the steps of: (1) feeding base resin and initiator to an extruder; (2) melting the base resin, thereby forming a polymer melt; (3) mixing the molten base resin and initiator at low temperature to enable good dispersion of the initiator in the base resin before the onset of crosslinking; (4) initiating crosslinking of the base resin with the initiator by raising the melt temperature and controlling it along the extruder channel; (5) retaining the polymer melt in the extruder for a sufficient residence time at a given temperature such that the required amount of crosslinking is achieved; (6) providing sufficiently high shear during the crosslinking reaction thereby keeping the gel particles formed during crosslinking small in size and well distributed in the polymer melt; (7) optionally devolatilizing the melt to remove any effluent volatiles; and (8) pumping the crosslinked resin melt through a die to a pelletizer.

A reactive melt mixing process is a process wherein chemical reactions can be carried out on the polymer in the melt phase in a melt mixing device, such as an extruder. In preparing the resins of the invention, these reactions are used to modify the chemical structure and the molecular weight, and thus the melt rheology and fusing properties, of the polymer. Reactive melt mixing is particularly efficient for highly viscous materials, and is advantageous because it requires no solvents, and thus is easily environmentally controlled. It is also advantageous because it permits a high degree of initial mixing of resin and initiator to take place, and provides an environment wherein a controlled high temperature (adjustable along the length of the extruder) is available so that a very quick reaction can occur. It also enables a reaction to take place continuously, and thus the reaction is not limited by the disadvantages of a batch process, wherein the reaction must be repeatedly stopped so that the reaction products may be removed and the apparatus cleaned and prepared for another similar reaction. As soon as the amount of crosslinking desired is achieved, the reaction products can be quickly removed from the reaction chamber.

The polymer coating weight is generally from about 0.1 to about 3 weight percent of the carrier composition, as follows $$\text{Polymer Coating Weight} = \frac{\text{Total Polymer Weight}}{\text{Total Polymer Weight} + \text{Total Core Weight}} \times 100\%$$

preferably about 0.5 to about 2 percent, or about 0.7 to about 1.3 percent. The remainder of the carrier is comprised of carrier core, preferably ferrite, sponge iron, or steel grit with an average particle size diameter of from between about 30 microns to about 200 microns. Coatings weights in this range are generally sufficient to ensure partial to complete coverage of the carrier core by the polyester polymer, allowing adjustment of the triboelectric and conductivity properties of the carrier through adjustment of the composition of the polyester polymer.

The polyester coating can have dispersed therein conductive components, such as metal oxides like tin oxide, conductive carbon blacks, and the like, in effective amounts of, for example, from about 1 to about 70 and preferably from about 20 to about 60 weight percent, defined as $$\text{Weight \%} = \frac{\text{Total Conductive Component Weight}}{\text{Total Weight of All Components Present in Polymer}} \times 100\%$$

Specific examples of conductive components include the conductive carbon black SC Ultra manufactured by Conductex, Inc., and antimony-doped tin oxide Zelec ECP3005-XC manufactured by DuPont. Incorporation of 20 percent of Conductex SC Ultra carbon black into the crosslinked polyester with a 30 percent gel content yields a carrier (1.0 percent coating on a steel grit core) with a conductivity value of $5.5\times10^{-10}$ mho/cm. Incorporation of 60 percent of DuPont Zelec ECP3005-XC antimony-doped tin oxide into the crosslinked polyester with a 30 percent gel content yields a carrier (1.0 percent coating on a steel grit core) with a conductivity value of $8.7\times10^{-12}$ mho/cm.

Also, the carrier coating can have incorporated therein various charge enhancing additives, such as quaternary ammonium salts, and more specifically, distearyl dimethyl ammonium methyl sulfate (DDAMS), bis[1-[(3,5-disubstituted-2-hydroxyphenyl)azo]-3-(mono-substituted)-2-naphthalenolato(2-)] chromate(1-), ammonium sodium and hydrogen (TRH), cetyl pyridinium chloride (CPC), FANAL PINK® D4830, and the like, including those as specificallly illustrated herein, and other effective known charge agents or additives. The charge additives are selected in various effective amounts, such as from about 0.05 to about 15 weight percent.

In addition, in embodiments the carrier may contain a mixture of the polyester coating and a second polymer, with the second polymer present at a concentration of from about 10 to 90 percent, such as polyvinylidenefluoride, polyvinylfluoride, polypentafluorostyrene, polyethylene, polymethylmethacrylate, copolyethylenevinylacetate, copolyvinylidenefluoride tetrafluoroethylene, and polyethylene; polymethylmethacrylate, polyurethane and copolyethylene. Other related polymers not specifically mentioned herein can be selected providing the objectives of the present invention are achieved, including for example polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate.

Close proximity refers in embodiments to the choice of the polymers selected as dictated by their position in the triboelectric series, therefore for example, one may select a first polymer with a significantly lower triboelectric charging value than the second polymer. For example, the triboelectric charge of a steel carrier core with a polyvinylidenefluoride coating is about −75 microcoulombs per gram. However, the same carrier, with the exception that there is selected a coating of polyethylene, has a triboelectric charging value of about −17 microcoulombs per gram. More specifically, not in close proximity refers to first and second polymers that are at different electronic work function values, that is they are not at the same electronic work function value; and further, the first and second polymers are comprised of different components. Additionally, the difference in electronic work functions between the first and second polymer is at least 0.2 electron volt, and preferably is about 2 electron volts; and moreover, it is known that the triboelectric series corresponds to the known electronic work function series for polymers, reference "Electrical Properties of Polymers", Seanor, D. A., Chapter 17, Polymer Science, A. D. Jenkins, Editor, North Holland Publishing (1972), the disclosure of which is totally incorporated herein by reference.

The percentage of each polymer present in the carrier coating mixture can vary depending on the specific components selected, the coating weight, and the properties desired. Generally, the coated polymer mixtures used contains from about 10 to about 90 weight percent of the first polymer, and from about 90 to about 10 percent by weight of the second polymer. Preferably, there are selected mixtures of polymers with from about 40 to 60 percent by weight of the first polymer, and from about 60 to 40 percent by weight of a second polymer. In one embodiment of the present invention, when a high triboelectric charging value is desired, that is exceeding −50 microcoulombs per gram, there is selected from about 90 percent by weight of the first polymer, such as polyvinylidenefluoride, and 10 percent by weight of the second polymer, such as polyester. In contrast, when a lower triboelectric charging value is required, less than about −20 microcoulombs per gram, there is selected from about 10 percent by weight of the first polymer; and 90 percent by weight of the second polymer.

Also, there results, in accordance with a preferred embodiment of the present invention, carrier particles of relatively constant conductivities from between about $10^{-15}$ mho-cm$^{-1}$ to from about $10^{-9}$ mho-cm$^{-1}$ at, for example, a 10 volt impact across a 0.1 inch gap containing carrier beads held in place by a magnet; and wherein the carrier particles are of a triboelectric charging value of from 5 microcoulombs per gram to 70 microcoulombs per gram, these parameters being dependent on the coatings selected, and the percentage of each of the polymers used as indicated hereinbefore.

Various effective suitable means can be used to apply the polymer, or mixture of polymer coatings to the surface of the carrier particles. Examples of typical means for this purpose include combining the carrier core material, and the polymer by cascade roll mixing, or tumbling, milling, shaking, electrostatic powder cloud spraying, fluidized bed, electrostatic disc processing, and an electrostatic curtain. Following application of the polymer, heating is initiated to permit flowout of the coating material over the surface of the carrier core. The concentration of the coating material powder particles, as well as the parameters of the heating step, may be selected to enable the formation of a continuous film of the coating material on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about 10-9 to about $10^{-7}$ mho-$cm^{-1}$ as measured, for example, across a 0.1 inch magnetic brush at an applied potential of 10 volts; and wherein the coating coverage encompasses from about 10 percent to about 100 percent of the carrier core.

Illustrative examples of finely divided toner resins selected for the developer compositions of the present invention include polyamides, epoxies, polyurethanes, diolefins, vinyl resins, polyesters, such as those obtained by the polymeric esterification products of a dicarboxylic acid and a diol comprising a diphenol. Specific vinyl monomers that can be used are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar substances.

As one preferred toner resin there can be selected the esterification products of a dicarboxylic acid and a diol comprising a diphenol, reference U.S. Pat. No. 3,590,000, the disclosure of which is totally incorporated herein by reference. Other preferred toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol.

Generally, from about 1 part to about 5 parts by weight of toner particles are mixed with from about 10 to about 300 parts by weight of the carrier particles prepared in accordance with the process of the present invention.

Numerous well known suitable pigments or dyes can be selected as the colorant for the toner particles including, for example, carbon black, nigrosine dye, lamp black, iron oxides, magnetites, and mixtures thereof. The pigment, which is preferably carbon black, should be present in a sufficient amount to render the toner composition highly colored. Thus, the pigment particles are present in amounts of from about 3 percent by weight to about 20 percent by weight, based on the total weight of the toner composition, however, lesser or greater amounts of pigment particles can be selected providing the objectives of the present invention are achieved.

When the pigment particles are comprised of magnetites, which are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant such as carbon black is contained therein, about 90 percent by weight of resin material is selected. Generally, however, providing the objectives of the present invention are achieved, the toner composition is comprised of from about 85 percent to about 97 percent by weight of toner resin particles, and from about 3 percent by weight to about 15 percent by weight of pigment particles such as carbon black.

Also encompassed within the scope of the present invention are colored toner compositions comprised of toner resin particles, carrier particles and as pigments or colorants, magenta, cyan and/or yellow particles, as well as mixtures thereof. More specifically, illustrative examples of magenta materials that may be selected as pigments include 1,9-dimethyl-substituted quinacridone and anthraquinone dye identified in the Color Index as Cl 60720, Cl Dispersed Red 15, a diazo dye identified in the Color Index as Cl 26050, Cl Solvent Red 19, and the like. Examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, permanent yellow FGL, and the like. These pigments are generally present in the toner composition in an amount of from about 1 weight percent to about 15 weight percent based on the weight of the toner resin particles.

For further enhancing the positive charging characteristics of the developer compositions described herein, and as optional components there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives. These additives are usually incorporated into the toner in an amount of from about 0.1 percent by weight to about 20 percent by weight. These charge additives can also be dispersed in the carrier polymer coating as indicated herein.

The toner composition of the present invention can be prepared by a number of known methods including melt blending the toner resin particles, and pigment particles or colorants of the present invention followed by mechanical attrition, emulsion/aggregation, and the like. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired product.

Also, the toner and developer compositions of the present invention may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules there can be selected the aryl diamines disclosed in the '990 patent. Also, there can be selected as photogenerating pigments, squaraine compounds, thiapyrillium materials, and the like. These layered members are conventionally charged negatively thus requiring a positively charged toner. Other photoresponsive devices useful in the present invention include polyvinylcarbazole 4-dimethylaminobenzylidene, benzhydrazide; 2-benzylidene-aminocarbazole, 4-dimethaminobenzylidene, (2-nitro-benzylidene)-p-bromoaniline; 2,4-diphenyl-quinazoline; 1,2,4-triazine; 1,5-diphenyl-3-methyl pyrazoline 2-(4'-dimethylaminophenyl)-benzoaxzole; 3-aminocarbazole, polyvinyl carbazole-trinitrofluorenone charge transfer complex; and mixtures thereof. Moreover, the developer compositions of the present invention are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference. One imaging member is comprised of aluminum, a photogenerating layer of trigonal selenium dispersed in polyvinyl carbazole thereover, and a charge transport layer of N,N'-diphenyl-N,N'-bis(3-methylphenyl)[1,1-biphenyl]-4,4'-diamine, 50 percent by weight dispersed in 50 percent by weight of polycarbonate.

Images obtained with this developer composition had acceptable solids, excellent halftones, and desirable line resolution with acceptable or substantially no background deposits.

The following Examples are being supplied to further define the present invention, it being noted that these Examples are intended to illustrate and not limit the scope of the present invention. Parts and percentages are by weight unless otherwise indicated.

EXAMPLE 1

A crosslinked unsaturated polyester resin was prepared by the reactive extrusion process by melt mixing 99.3 parts of a linear unsaturated polyester with the following structure:

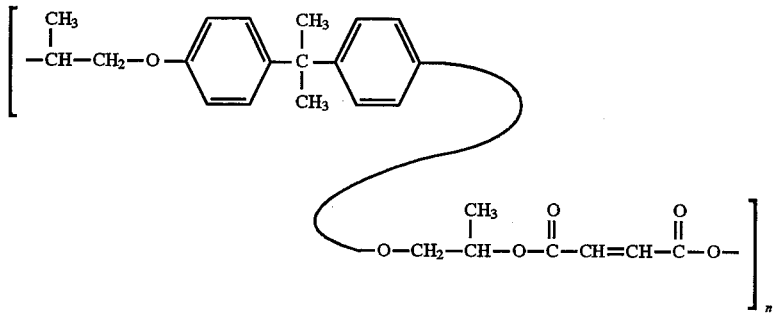

wherein n was the number of repeating units and having $M_n$ of about 4,000, $M_w$ of about 10,300, $M_w/M_n$ of about 2.58 as measured by GPC, onset $T_g$ of about 55° C. as measured by DSC, and melt viscosity of about 29,000 poise at 100° C. and about 750 poise at 130° C. as measured at 10 radians per second, and 0.7 part of benzoyl peroxide initiator as outlined in the following procedure.

The unsaturated polyester resin and benzoyl peroxide initiator were blended in a rotary tumble blender for 30 minutes. The resulting dry mixture was then fed into a Werner & Pfleiderer ZSK-30 twin screw extruder with a screw diameter of 30.7 millimeters and a length-to-diameter (L/D) ratio of 37.2 at 10 pounds per hour using a loss-in-weight feeder. The crosslinking was carried out in the extruder using the following process conditions: barrel temperature profile of 70°/140°/140°/140°/140°/140°/140° C., die head temperature of 140° C., screw speed of 100 revolutions per minute and average residence time of about three minutes. The extrudate melt, upon exiting from the strand die, was cooled in a water bath and pelletized. The product, which was crosslinked polyester, had an onset $T_g$ of about 54° C. as measured by DSC, melt viscosity of about 40,000 poise at 100° C. and about 150 poise at 160° C. as measured at 10 radians per second, a gel content of about 0.7 weight percent, and a mean microgel particle size of about 0.1 micron as determined by transmission electron microscopy.

The linear and crosslinked portions of the product were separated by dissolving the product in tetrahydrofuran and filtering off the microgel. The dissolved part was reclaimed by evaporating the tetrahydrofuran. This linear part of the resin, when characterized by GPC, was found to have $M_n$ of about 3,900, $M_w$ of about 10,100, $M_w/M_n$ of about 2.59, and onset $T_g$ of 55° C., which was substantially the same as the original noncrosslinked resin, which indicated that it contained no sol.

EXAMPLE II

A crosslinked unsaturated polyester resin was prepared by the reactive extrusion process by melt mixing 98.6 parts of a linear unsaturated polyester with the structure and properties described in Example I, and 1.4 parts of benzoyl peroxide initiator as outlined in the following procedure.

The unsaturated polyester resin and benzoyl peroxide initiator were blended in a rotary tumble blender for 30 minutes. The resulting dry mixture was then fed into a Werner & Pfleiderer ZSK-30 twin screw extruder at 10 pounds per hour using a loss-in-weight feeder. The crosslinking was carried out in the extruder using the following process conditions: barrel temperature profile of 70°/160°/160°/160°/160°/160°/160° C., die head temperature of 160° C., screw rotational speed of 100 revolutions per minute, and average residence time of about three minutes. The extrudate melt, upon exiting from the strand die, was cooled in a water bath and pelletized. The product, which was crosslinked polyester, had an onset $T_g$ of about 54° C. as measured by DSC, melt viscosity of about 65,000 poise at 100° C. and about 12,000 poise at 160° C. as measured at 10 radians per second, a gel content of about 50 weight percent, and a mean microgel particle size of about 0.1 micron as determined by transmission electron microscopy.

The linear and crosslinked portions of the product were separated by dissolving the product in tetrahydrofuran and filtering off the microgel. The dissolved part was reclaimed by evaporating the tetrahydrofuran. This linear part of the resin, when characterized by GPC, was found to have $M_n$ of about 3,900, $M_w$ of about 10,100, $M_w/M_n$ of about 2.59, and onset $T_g$ of 55° C., which was substantially the same as the original noncrosslinked resin, which indicated that it contained no sol.

EXAMPLE III

A crosslinked polyester prepared in the manner described in Examples I and II with a gel content of 5 percent was coated onto a carrier core as follows. The crosslinked polyester was first size reduced in an 0202 Jet-O-Mizer grinder to a volume median particle size of about 7 μm. 23 grams of the ground polyester obtained were mixed in a V-cone blender for 20 minutes at a speed of 27.5 rpm with 2.3 kilograms of a 90 μm diameter Hoeganese porous steel core. There resulted uniformly distributed and electrostatically attached, as determined by visual observation, on the carrier core the crosslinked polyester. Thereafter, the resulting carrier particles were inserted into a rotating tube furnace for a period of 30 minutes. This furnace was maintained at a temperature of 400° F. thereby causing the polymer to melt and fuse to the core.

A developer composition was then prepared by mixing 194 grams of the above prepared carrier particles with 6 grams of a toner composition comprised of 87 percent by weight of the above crosslinked polyester resin, 5 percent by weight of Cabot Corporation REGAL 330® carbon black, 4 percent by weight of a KRATON® polypropylene wax, and 4 percent by weight of a block copolymer compatibilizing agent. Thereafter, the triboelectric charge on the carrier particles was determined by the known Faraday Cage process, and there was measured on the carrier a charge of 12.3 microcoulombs per gram. Further, the conductivity of the carrier as determined by forming a 0.1 inch long magnetic brush of the carrier particles, and measuring the conductivity by imposing a 10 volt potential across the brush, was $2.5\times10^{-14}$ mho-cm$^{-1}$. Therefore, these carrier particles are insulating.

In all the working Examples, the triboelectric charging values and the conductivity numbers were obtained in accordance with the aforementioned procedure.

EXAMPLE IV

The procedure of Example III was repeated with the exception that during the carrier fusing process the kiln temperature was maintained at 450° F.

A developer composition was then prepared by mixing 194 grams of the above prepared carrier particles with 6 grams of the toner composition described in Example III. Thereafter, the triboelectric charge on the carrier particles was determined by the known Faraday Cage process, and there was measured on the carrier a charge of 12.4 microcoulombs per gram. Further, the conductivity of the carrier as determined by forming a 0.1 inch long magnetic brush of the carrier particles, and measuring the conductivity by imposing a 10 volt potential across the brush, was $5.9\times10^{-14}$ mho-cm$^{-1}$. Therefore, these carrier particles are insulating.

EXAMPLE V

The procedure of Example III was repeated with the exception that during the carrier fusing process the kiln temperature was maintained at 500° F.

A developer composition was then prepared by mixing 194 grams of the above prepared carrier particles with 6 grams of the toner composition described in Example III. Thereafter, the triboelectric charge on the carrier particles was determined by the known Faraday Cage process, and there was measured on the carrier a charge of 10.5 microcoulombs per gram. Further, the conductivity of the carrier as determined by forming a 0.1 inch long magnetic brush of the carrier particles, and measuring the conductivity by imposing a 10 volt potential across the brush, was $1.3\times10^{-14}$ mho-cm$^{-1}$. Therefore, these carrier particles are insulating.

EXAMPLE VI

The crosslinked polyester prepared in the manner described in Examples I and II with a gel content of 26 percent was coated onto a carrier core as follows. The crosslinked polyester was first size reduced in an 0202 Jet-O-Mizer grinder to a volume median particle size of about 6.5 μm. 23 Grams of the ground polyester were then mixed in a V-cone blender for 20 minutes at a speed of 27.5 rpm with 2.3 kilograms of a 90 μm diameter Hoeganese porous steel core. There resulted uniformly distributed and electrostatically attached, as determined by visual observation, on the carrier core the crosslinked polyester. Thereafter, the resulting carrier particles were inserted into a rotating tube furnace for a period of 30 minutes. This furnace was maintained at a temperature of 400° F. thereby causing the polymer to melt and fuse to the core.

A developer composition was then prepared by mixing 194 grams of the above prepared carrier particles with 6 grams of a toner composition comprised of 87 percent by weight of the above crosslinked polyester resin, 5 percent by weight of carbon black, 4 percent by weight of a polypropylene wax, and 4 percent by weight of a compatibilizing agent comprised of KRATON® obtained from Shell Chemicals. Thereafter, the triboelectric charge on the carrier particles was determined by the known Faraday Cage process, and there was measured on the carrier a charge of 9.0 microcoulombs per gram. Further, the conductivity of the carrier as determined by forming a 0.1 inch long magnetic brush of the carrier particles, and measuring the conductivity by imposing a 10 volt potential across the brush, was $2.1\times10^{-14}$ mho-cm$^{-1}$. Therefore, these carrier particles are insulating.

EXAMPLE VII

The procedure of Example VI was repeated with the exception that during the carrier fusing process the kiln temperature was maintained at 450° F.

A developer composition was then prepared by mixing 194 grams of the above prepared carrier particles with 6 grams of the toner composition described in Example III. Thereafter, the triboelectric charge on the carrier particles was determined by the known Faraday Cage process, and there was measured on the carrier a charge of 8.9 microcoulombs per gram. Further, the conductivity of the carrier as determined by forming a 0.1 inch long magnetic brush of the carrier particles, and measuring the conductivity by imposing a 10 volt potential across the brush, was $2.3\times10^{-14}$ mho-cm$^{-1}$. Therefore, these carrier particles were insulating.

EXAMPLE VIII

The procedure of Example VI was repeated with the exception that during the carrier fusing process the kiln temperature was maintained at 500° F.

A developer composition was then prepared by mixing 194 grams of the above prepared carrier particles with 6 grams of the toner composition described in Example III. Thereafter, the triboelectric charge on the carrier particles was determined by the known Faraday Cage process, and there was measured on the carrier a charge of 9.2 microcoulombs per gram. Further, the conductivity of the carrier as determined by forming a 0.1 inch long magnetic brush of the carrier particles, and measuring the conductivity by imposing a 10 volt potential across the brush, was $2.2\times10^{-14}$ mho-cm$^{-1}$. Therefore, these carrier particles were insulating.

EXAMPLE IX

A crosslinked polyester prepared in the manner described in Examples I and II with a gel content of 45 percent was coated onto a carrier core as follows. The crosslinked polyester was first size reduced in an 0202 Jet-O-Mizer grinder to a volume median particle size of about 6.5 μm. 23 Grams of the ground polyester were then mixed in a V-cone blender for 20 minutes at a speed of 27.5 rpm with 2.3 kilograms of a 90 μm diameter Hoeganese porous steel core. There resulted uniformly distributed and electrostatically attached, as determined by visual observation, on the carrier core the crosslinked polyester. Thereafter, the resulting carrier particles were inserted into a rotating tube furnace for a period of 30 minutes. This furnace was maintained at a temperature of 400° F. thereby causing the polymer to melt and fuse to the core.

A developer composition was then prepared by mixing 194 grams of the above prepared carrier particles with 6 grams of a toner composition comprised of 87 percent by weight of the above crosslinked polyester resin, 5 percent by weight of carbon black, 4 percent by weight of a polypropylene wax, and 4 percent by weight of the KRATON® block copolymer compatibilizing agent. Thereafter, the triboelectric charge on the carrier particles was determined by the known Faraday Cage process, and there was measured on the carrier a charge of 14.7 microcoulombs per gram. Further, the conductivity of the carrier as determined by forming a 0.1 inch long magnetic brush of the carrier particles, and measuring the conductivity by imposing a 10 volt potential across the brush, was $2.5\times10^{-14}$ mho-cm$^{-1}$. Therefore, these carrier particles were insulating.

EXAMPLE X

The procedure of Example IX was repeated with the exception that during the carrier fusing process the kiln temperature was maintained at 450° F.

A developer composition was then prepared by mixing 194 grams of the above prepared carrier particles with 6 grams of the toner composition described in Example III. Thereafter, the triboelectric charge on the carrier particles was determined by the known Faraday Cage process, and there was measured on the carrier a charge of 14.8 microcoulombs per gram. Further, the conductivity of the carrier as determined by forming a 0.1 inch long magnetic brush of the carrier particles, and measuring the conductivity by imposing a 10 volt potential across the brush, was $1.4\times10^{-14}$ mho-cm$^{-1}$. Therefore, these carrier particles were insulating.

EXAMPLE XI

The procedure of Example IX was repeated with the exception that during the carrier fusing process the kiln temperature was maintained at 500° F.

A developer composition was then prepared by mixing 194 grams of the above prepared carrier particles with 6 grams of the toner composition described in Example III. Thereafter, the triboelectric charge on the carrier particles was determined by the known Faraday Cage process, and there was measured on the carrier a charge of 15.4 microcoulombs per gram. Further, the conductivity of the carrier as determined by forming a 0.1 inch long magnetic brush of the carrier particles, and measuring the conductivity by imposing a 10 volt potential across the brush, was $1.0\times10^{-14}$ mho-cm$^{-1}$. Therefore, these carrier particles were insulating.

EXAMPLE XII

Crosslinked polyester prepared in the manner described in Examples I and II with a gel content of 30 percent was coated onto a carrier core as follows. The crosslinked polyester was first size reduced in a 15 inch Sturtevant Fluid Energy Mill grinder to a volume median particle size of about 8.7 μm. 681 Grams of the ground polyester were mixed in a Munson MX-1 Minimixer for 30 minutes at a speed of 27.5 rpm with 68 kilograms of a 90 μm diameter Hoeganese porous steel core. There resulted uniformly distributed and electrostatically attached, as determined by visual observation, on the carrier core the crosslinked polyester. Thereafter, the resulting carrier particles were metered into a rotating tube furnace at a rate of 450 grams/minute. This furnace was maintained at a temperature of 400° F. thereby causing the polymer to melt and fuse to the core.

A developer composition was then prepared by mixing 194 grams of the above prepared carrier particles with 6 grams of a toner composition comprised of 87 percent by weight of the above crosslinked polyester resin, 5 percent by weight of carbon black, 4 percent by weight of a polypropylene wax, and 4 percent by weight of the KRATON® block copolymer compatibilizing agent. Thereafter, the triboelectric charge on the carrier particles was determined by the known Faraday Cage process, and there was measured on the carrier a charge of 15.0 microcoulombs per gram. Further, the conductivity of the carrier as determined by forming a 0.1 inch long magnetic brush of the carrier particles, and measuring the conductivity by imposing a 10 volt potential across the brush, was $2.1\times10^{-14}$ mho-cm$^{-1}$. Therefore, these carrier particles are insulating.

EXAMPLE XIII

A crosslinked polyester prepared in the manner described in Examples I and II with a gel content of 30 percent was mixed with 3 weight percent of the charge control agent benzoic acid, 2-[6-(ethylamino)-3-(ethylamino)-2,7-dimethyl-3H-xanthen-9-yl]-ether ester, and molybdenum tungsten hydroxide oxide phosphate (FANAL PINK® 4830 obtained from BASF) by a melt-mix process in an APV extruder. The extrusion conditions were a barrel set temperature of 124° C., a die set temperature of 220° F., a screw rpm of 250, and a torque of 67 percent. The resulting extrudate was coated onto a carrier core as follows. The crosslinked polyester/FANAL PINK® 4830 composite was first size reduced in an 0202 Jet-O-Mizer grinder to a volume median particle size of about 6.9 pm. 23 Grams of the ground polyester/carbon black composite were mixed in a V-cone blender for 20 minutes at a speed of 27.5 rpm with 2.3 kilograms of a 90 μm diameter Hoeganese porous steel core. There resulted uniformly distributed and electrostatically attached, as determined by visual observation, on the carrier core the crosslinked polyester. Thereafter, the resulting carrier particles were inserted into a rotating tube furnace for a period of 30 minutes. This furnace was maintained at a temperature of 450° F. thereby causing the polymer to melt and fuse to the core.

A developer composition was then prepared by mixing 194 grams of the above prepared carrier particles with 6 grams of a toner composition comprised of 87 percent by weight of the above crosslinked polyester resin, 5 percent by weight of carbon black, 4 percent by weight of a polypropylene wax, and 4 percent by weight of the KRATON® block copolymer compatibilizing agent. Thereafter, the triboelectric charge on the carrier particles was determined by the known Faraday Cage process, and there was measured on the carrier a charge of 16.2 microcoulombs per gram. Further, the conductivity of the carrier as determined by forming a 0.1 inch long magnetic brush of the carrier particles, and measuring the conductivity by imposing a 10 volt potential across the brush, was $2.2\times10^{-15}$ mho-cm$^{-1}$. Therefore, these carrier particles are insulative.

EXAMPLE XIV

The procedure of Example XIII was repeated with the exception that during the carrier fusing process the kiln temperature was maintained at 500° F.

A developer composition was then prepared by mixing 194 grams of the above prepared carrier particles with 6 grams of the toner composition described in Example III. Thereafter, the triboelectric charge on the carrier particles was determined by the known Faraday Cage process, and there was measured on the carrier a charge of 15.0 microcoulombs per gram. Further, the conductivity of the carrier as determined by forming a 0.1 inch long magnetic brush of the carrier particles, and measuring the conductivity by imposing a 10 volt potential across the brush, was $3.0\times10^{-9}$ mho-cm$^{-1}$. Therefore, these carrier particles are conductive.

EXAMPLE XV

A ground crosslinked polyester/carbon black composite of Examples XIII and XIV were coated onto a carrier core as follows. 431 Grams of the ground polyester was mixed in a Munson MX-1 Minimixer for 30 minutes at a speed of 27.5 rpm with 43 kilograms of a 90 μm diameter Hoeganese porous steel core. There resulted uniformly distributed and electrostatically attached, as determined by visual observation, on the carrier core the crosslinked polyester. Thereafter, the resulting carrier particles were metered into a rotating tube furnace at a rate of 450 grams/minute. This furnace was maintained at a temperature of 400° F. thereby causing the polymer to melt and fuse to the core.

A developer composition was then prepared by mixing 194 grams of the above prepared carrier particles with 6 grams of a toner composition comprised of 87 percent by weight of the above crosslinked polyester resin, 5 percent by weight of carbon black, 4 percent by weight of polypropylene wax, and 4 percent by weight of a block copolymer compatibilizing agent. Thereafter, the triboelectric charge on the carrier particles was determined by the known Faraday Cage process, and there was measured on the carrier a charge of 16.2 microcoulombs per gram. Further, the conductivity of the carrier as determined by forming a 0.1 inch long magnetic brush of the carrier particles, and measuring the conductivity by imposing a 10 volt potential across the brush, was $5.5\times10^{-10}$ mho-cm$^{-1}$. Therefore, these carrier particles were conducting.

EXAMPLE XVI

A crosslinked polyester prepared in the manner described in Examples I and II with a gel content of 30 percent was combined with 60 percent of a conductive tin oxide pigment by a melt-mix process in an APV extruder. The extrusion conditions were a barrel set temperature of 120° C., a die set temperature of 285° F., a screw rpm of 240, and a torque of between 60 and 90 percent. The resulting extrudate was coated onto a carrier core as follows. The crosslinked polyester/carbon black composite was first size reduced in a 15 inche Sturtevant Fluid Energy Mill grinder to a volume median particle size of about 7.8 μm. 631 Grams of the ground polyester were mixed in a Munson MX-1 Minimixer for 30 minutes at a speed of 27.5 rpm with 63 kilograms of a 90 μm diameter Hoeganese porous steel core. There resulted uniformly distributed and electrostatically attached, as determined by visual observation, on the carrier core the crosslinked polyester. Thereafter, the resulting carrier particles were metered into a rotating tube furnace at a rate of 450 grams/minute. This furnace was maintained at a temperature of 400° F. thereby causing the polymer to melt and fuse to the core.

A developer composition was then prepared by mixing 194 grams of the above prepared carrier particles with 6 grams of a toner composition comprised of 87 percent by weight of the above crosslinked polyester resin, 5 percent by weight of carbon black, 4 percent by weight of a polypropylene wax, and 4 percent by weight of the KRATON® block copolymer compatibilizing agent. Thereafter, the triboelectric charge on the carrier particles was determined by the known Faraday Cage process, and there was measured on the carrier a charge of 24.6 microcoulombs per gram. Further, the conductivity of the carrier as determined by forming a 0.1 inch long magnetic brush of the carrier particles, and measuring the conductivity by imposing a 10 volt potential across the brush, was $8.7\times10^{-12}$ mho-cm$^{-1}$. Therefore, these carrier particles were semiconductive.

EXAMPLE XVII

The developer composition prepared in Example XVI was aged in a hybrid scavengeless-based Xerox Corporation 5090 xerographic development fixture for a total time of 30 hours. Toner throughput in development was furnished by the use of a scraper blade. For comparison, a developer composition identical to that of Example XV with the exception that the carrier consisted of uncoated carrier core (no polyester/carbon black polymer coating) was aged under identical conditions. The conductivity of the developer composition prepared in Example XV was approximately two orders of magnitude lower than that of the developer composition prepared with bare core. Both materials assumed less conductivity with age. The triboelectric characteristics of the developers were also characterized as a function of aging time. The triboelectric value of the developer containing carrier consisting of core only was significantly higher than that of the developer composition identical to that of Example XV, although the core triboelectric value showed deterioration with age. The developer composition of Example XVI had a very stable triboelectric value throughout the test, superior to that of developer containing carrier consisting of core only, and comparable to that of a steel core carrier coated with poly(methylmethacrylate), 80 weight percent, and 20 weight percent of Conductex SC Ultra carbon black.

EXAMPLE XVIII

A crosslinked polyester prepared in the manner described in Examples I and II with a gel content of 30 percent was combined with 60 percent of a conductive tin oxide pigment by a melt mix process in an APV extruder. The extrusion conditions were a barrel set temperature of 120° C., a die set temperature of 285° F., a screw RPM of 240, and a torque of between 60 and 90 percent. The resulting extrudate was coated onto a carrier core as follows. The crosslinked polyester/carbon black composite was first size reduced in a 15 inch Sturtevant Fluid Energy Mill grinder to a volume median particle size of about 7.8 pm. 631 Grams of the ground polyester were mixed in a Munson MX-1 Minimixer for 30 minutes at a speed of 27.5 RPM with 63 kilograms of a 90 μm diameter Hoeganese porous steel core. There resulted uniformly distributed and electrostatically attached, as determined by visual observation, on the carrier core the crosslinked polyester. Thereafter, the resulting carrier particles were metered into a rotating tube furnace at a rate of 450 grams/minute. This furnace was maintained at a temperature of 400° F. thereby causing the polymer to melt and fuse to the core.

A developer composition was then prepared by mixing 194 grams of the above prepared carrier particles with 6 grams of a toner composition comprised of 87 percent by weight of the above crosslinked polyester resin, 5 percent by weight of carbon black, 4 percent by weight of a polypropylene wax, and 4 percent by weight of KRATON® block copolymer compatibilizing agent. Thereafter, the triboelectric charge on the carrier particles was determined by the known Faraday Cage process, and there was measured on the carrier a charge of 24.6 microcoulombs per gram. Further, the conductivity of the carrier as determined by forming a 0.1 inch long magnetic brush of the carrier particles, and measuring the conductivity by imposing a 10 volt potential across the brush, was $8.7\times10^{-12}$ mho-cm$^{-1}$. Therefore, these carrier particles were semiconductive.

Reload, which refers to the mass of toner developed onto the portion of the donor roll which was scraped to furnish toner throughput in the development fixture, of the developer composition of Example XVI was superior, that is for example was consistently higher to that of the developer composition prepared with uncoated carrier core; therefore, the image obtained in a xerographic engine with the developer composition of Example XVI evidenced a more completely developed (i.e., darker) image with superior image resolution to that of the developer composition prepared with uncoated carrier core, even though the conductivity was higher in the latter carrier.

The stability of triboelectric value of the developer composition of Example XV with time suggested that the carrier coating remained intact during the 30 hour test.

With further reference to the above Examples, the conductivity values were obtained as indicated herein. Specifically, these values were generated by the formation of a magnetic brush with the prepared carrier particles. The brush was present within a one electrode cell consisting of the magnet as one electrode and a nonmagnetic steel surface as the opposite electrode. A gap of 0.100 inch was maintained between the two electrodes and a 10 volt bias was applied in this gap. The resulting current through the brush was recorded and the conductivity was calculated based on the measured current and geometry.

More specifically, the conductivity in mho-cm$^{-1}$ was the product of the current, and the thickness of the brush, about 0.254 centimeter divided by the product of the applied voltage and the effective electrode area.

With insulating developers, there were usually obtained images of high copy quality with respect to both lines and halftones, however, solid areas were of substantially lower quality. In contrast, with conductive developers there were achieved enhanced solid areas with low line resolution and inferior halftones.

With respect to the triboelectric numbers in microcoulombs per gram, they were determined by placing the developer materials in an 8 ounce glass jar with 3.0 percent by weight of toner compositions, placed on a Red Devil Paint Shaker and agitated for 10 minutes. Subsequently, the jar was removed and samples from the jar were placed in a known tribo Faraday Cage apparatus. The blow off tribo of the carrier particles was then measured.

Embodiments of the present invention include a carrier composition comprised of a core with a coating thereover comprised of a polyester, and which polyester comprises linear portions and crosslinked portions, and wherein said crosslinked portions are comprised of high density crosslinked microgel particles; a carrier composition comprised of a core with a polymer coating thereover comprised of a crosslinked polyester and which polyester comprises linear portions and crosslinked portions, and wherein said crosslinked portions consist essentially of high density crosslinked microgel particles, and wherein the gel content thereof is from about 1 to about 50 percent; wherein the said microgel particles are present in an amount from about 0.001 to about 50 percent by weight of said polyester; wherein said microgel particles are present in an amount from 0.1 to about 40 percent by weight of said polyester; a carrier wherein said microgel particles have no more than a single bridging molecule between crosslinked chains, wherein said linear portions comprise linear unsaturated polyester resin, wherein the degree of unsaturation in said linear portions is from about 0.1 to about 30 mole percent; wherein said degree of unsaturation is from about 5 to about 25 mole percent; wherein said linear portions have a number average molecular weight ($M_n$) as measured by gel permeation chromatography in the range of from about 1,000 to about 20,000; wherein the conductive component is present in an amount of from about 1 to about 70 weight percent; a carrier with a conductivity of from about $1\times10^{-8}$ mho/centimeter to about $1\times10^{-15}$ mho/centimeter and a triboelectric charge of from about 5 to 30 microcoulombs per gram; a carrier with a conductivity of from about $1\times10^{-8}$ mho/centimeter to about $1\times10^{-15}$ mho/centimeter and a triboelectric charge value of from about 5 to 30 microcoulombs per gram; a carrier with a conductivity of from about 0.1 to 3.0 percent polymer by weight and containing a conductive component present in an amount of from about 0 to about 60 weight percent, and which carrier possesses a conductivity of from about $1\times10^{-8}$ mho/centimeter to about $1\times10^{-15}$ mho/centimeter and a triboelectric value of from about 5 to 30 microcoulombs per gram; a carrier with a charge additive in the carrier polyester coating and which charge additive is distearyl dimethyl ammonium methyl sulfate (DDAMS), bis[1-[(3,5-disubstituted-2-hydroxyphenyl)azo]-3-(monosubstituted)-2-naphthalenolato(2-)] chromate(1-), ammonium sodium and hydrogen (TRH), or cetyl pyridinium chloride (CPC); or benzoic acid, 2-[6-(ethylamino)-2,7-dimethyl-3H-xanthen-9-yl]-ethyl ester, and compound with molybdenum tungsten hydroxide oxide phosphate, and a process for the preparation of carrier particles with substantially stable conductivity parameters which comprises (1) mixing carrier cores with the polyester illustrated herein; (2) dry mixing the carrier core particles and the polymer for a sufficient period of time enabling the polymer to adhere to the carrier core particles; (3) heating the mixture of carrier core particles and polymer to a temperature of between about 200° F. and about 550° F., whereby the polymer melts and fuses to the carrier core particles; and (4) thereafter cooling the resulting coated carrier particles.

The carbon black selected for the Examples was, unless otherwise indicated, REGAL 330®; the polypropylene was of a low molecular weight, about 7,000 it is believed, and was obtained from Sanyo Chemicals of Japan, or VISCOL 660P®; and the Kraton compatibilizer was a styrene-ethylene-butylene styrene block copolymer (Shell KRATON G 1726X®), reference U.S. Pat. No. 5,229,242, the disclosure of which is totally incorporated herein by reference.

Other embodiments and modifications of the present invention may occur to those of ordinary skill in the art subsequent to a review of the present application and the information presented herein; these embodiments and modifications, as well as equivalents thereof, are also included within the scope of this invention.

What is claimed is:

1. A carrier composition comprised of a core with a coating thereover comprised of a polyester, and which polyester comprises linear portions and crosslinked portions, and wherein said crosslinked portions are comprised of high density crosslinked microgel particles.

2. A carrier comprised of a core with a polymer coating thereover comprised of a crosslinked polyester, and which polyester comprises linear portions and crosslinked portions, and wherein said crosslinked portions consist essentially of high density crosslinked microgel particles, and wherein the gel content thereof is from about 1 to about 50 percent.

3. A carrier composition in accordance with claim 1 wherein the polyester polymer coating is present in an amount of from about 10 percent by weight of the coating to about 90 percent by weight of the coating, and wherein said weight percent is determined by dividing the weight of said polyester coating by the sum of the weight of said carrier core and said polyester polymer.

4. A carrier composition in accordance with claim 1 wherein the core is selected from the group consisting of iron, ferrites, steel and nickel.

5. A developer composition comprised of the carrier particles of claim 1, and a toner composition comprised of thermoplastic resin particles and pigment particles.

6. A developer composition in accordance with claim 5 wherein the resin is comprised of styrene polymers.

7. A developer composition in accordance with claim 6 wherein the styrene polymers are selected from the group consisting of styrene methacrylates and styrene acrylates.

8. A developer composition in accordance with claim 5 wherein the toner resin is selected from the group consisting of polyesters and styrene butadienes.

9. A developer composition in accordance with claim 5 wherein the pigment particles are carbon black.

10. A developer composition in accordance with claim 5 wherein the toner contains therein charge enhancing additives.

11. A developer composition in accordance with claim 10 wherein the charge enhancing additive is selected from the group consisting of alkyl pyridinium halides, organic sulfate and sulfonate compositions, and distearyl dimethyl ammonium methyl sulfate.

12. A carrier in accordance with claim 1 wherein the said microgel particles are present in an amount from about 0.001 to about 50 percent by weight of said polyester.

13. A carrier composition in accordance with claim 1 wherein said microgel particles are present in an amount from 0.1 to about 40 percent by weight of said polyester.

14. A carrier composition in accordance with claim 1 wherein said microgel particles are no more than about 0.1 micron in average volume diameter and are substantially uniformly distributed in said resin.

15. A carrier composition in accordance with claim 14 wherein said average volume diameter is about 0.005 to about 0.1 micron.

16. A carrier in accordance with claim 2 wherein said microgel particles have no more than a single bridging molecule between crosslinked chains, wherein said linear portions comprise linear unsaturated polyester resin, wherein the degree of unsaturation in said linear portions is from about 0.1 to about 30 mole percent; wherein said degree of unsaturation is from about 5 to about 25 mole percent; wherein said linear portions have a number average molecular weight ($M_n$) as measured by gel permeation chromatography in the range of from about 1,000 to about 20,000.

17. A carrier composition in accordance with claim 16 wherein the carrier core is selected from the group consisting of iron, ferrites, steel and nickel.

18. A carrier composition in accordance with claim 1 further containing a conductive component, or conductive components in said polymer coating.

19. A carrier composition in accordance with claim 2 further containing a conductive component in said polymer coating.

20. A carrier composition in accordance with claim 19 wherein the conductive component is present in an amount of from about 1 to about 70 weight percent.

21. A carrier composition in accordance with claim 19 wherein the conductive component is present in an amount of from about 20 to about 60 weight percent.

22. A carrier composition in accordance with claim 19 wherein the conductive component is carbon black.

23. A carrier composition in accordance with claim 19 wherein the conductive component is a metal oxide.

24. A carrier in accordance with claim 19 wherein the conductive component is a conductive carbon black, or antimony-doped tin oxide.

25. A carrier in accordance with claim 2 with a conductivity of from about $1\times10^{-8}$ mho/centimeter to about $1\times10^{-15}$ mho/centimeter, and a triboelectric charge of from about a positive or a negative 7 to 70 microcoulombs per gram.

26. A carrier in accordance with claim 19 with a conductivity of from about $1\times10^{-8}$ mho/centimeter to about $1\times10^{-15}$ mho/centimeter, and a triboelectric charge value of from about 5 to 30 microcoulombs per gram.

27. A carrier in accordance with claim 19 with from about 0.1 to 3.0 percent of polymer by weight and containing a conductive component present in an amount of from about 0.05 to about 60 weight percent, and which carrier possesses a conductivity of from about $1\times10^{-8}$ mho/centimeter to about $1\times10^{-15}$ mho/centimeter and a negative triboelectric value of from about 5 to 30 microcoulombs per gram.

28. A carrier in accordance with claim 2 further containing charge enhancing additive in the coating.

29. A carrier in accordance with claim 28 wherein the charge additive in the coating is distearyl dimethyl ammonium methyl sulfate, bis[1-[(3,5-disubstituted-2-hydroxyphenyl)azo]-3-(mono-substituted)-2-naphthalenolato(2-)] chromate(1-), ammonium sodium, hydrogen (TRH), cetyl pyridinium chloride, benzoic acid, 2-[6-(ethylamino)-3-(ethylamino)-2,7-dimethyl-3H-xanthen-9-yl]-ethyl ester, or molybdenum tungsten hydroxide oxide phosphate.

30. A carrier in accordance with claim 2 further containing a second polymer coating.

31. A process for the preparation of carrier particles with substantially stable conductivity parameters which comprises (1) mixing carrier cores with the polyester of claim 1; (2) dry mixing the carrier core particles and the polymer for a sufficient period of time enabling the polymer to adhere to the carrier core particles; (3) heating the mixture of carrier core particles and polymer to a temperature of between about 200° F. and about 550° F., whereby the polymer melts and fuses to the carrier core particles; and (4) thereafter cooling the resulting coated carrier particles.

32. A process in accordance with claim 31 wherein the carrier core is selected from the group consisting of iron, steel, and ferrites.

33. A process in accordance with claim 31 wherein the resulting carrier particles are of a conductivity of from about 10-6 mho-cm-1 to about $10^{-17}$ mho-$cm^{-1}$, wherein the triboelectric charging value of the resulting carrier particles is from about 5 microcoulombs per gram to about 80 microcoulombs per gram, and wherein the polyester coating is continuous, and is present in a thickness of from about 0.2 micron to about 1.5 microns.

34. A process in accordance with claim 31 wherein the carrier core particles have an average particle diameter of between about 30 microns and about 200 microns.

35. A process in accordance with claim 3 wherein said coating amount is from about 20 to about 40 weight percent.

* * * * *